US007748092B2

(12) United States Patent
Rovellini

(10) Patent No.: US 7,748,092 B2
(45) Date of Patent: Jul. 6, 2010

(54) APPARATUS FOR CRIMPING CHEMICAL-FIBRE FILAMENTS AND CONTROL METHODS THEREOF

(75) Inventor: Marco Rovellini, Piacenza (IT)

(73) Assignee: M.A.E. S.p.A., Piacenza (IT)

( * ) Notice: Subject to any disclaimer, the term of this patent is extended or adjusted under 35 U.S.C. 154(b) by 0 days.

(21) Appl. No.: 12/395,832

(22) Filed: Mar. 2, 2009

(65) Prior Publication Data

US 2009/0230583 A1 Sep. 17, 2009

(30) Foreign Application Priority Data

Mar. 3, 2008 (EP) ..... 08425131

(51) Int. Cl.
*D02G 1/12* (2006.01)

(52) U.S. Cl. ..... 28/263; 28/248

(58) Field of Classification Search ..... 28/263, 28/248, 250, 262, 264, 268, 269, 265, 270, 28/251, 247; 264/40.3, 40.5, 103, 168, 211.12, 264/211.14

See application file for complete search history.

(56) References Cited

U.S. PATENT DOCUMENTS

| | | | | | |
|---|---|---|---|---|---|
| 2,734,229 | A | * | 2/1956 | Shattuck | 28/250 |
| 2,740,992 | A | * | 4/1956 | Shattuck | 28/250 |
| 2,820,988 | A | * | 1/1958 | Wegener | 28/250 |
| 2,856,640 | A | * | 10/1958 | Klein | 28/269 |
| 2,862,279 | A | * | 12/1958 | Fardon, Jr. et al. | 28/269 |
| 3,353,223 | A | * | 11/1967 | Coffin, Jr. et al. | 19/66 R |
| 3,526,023 | A | * | 9/1970 | Mertens | 28/248 |
| 3,639,955 | A | * | 2/1972 | Fleissner et al. | 28/269 |
| 3,800,373 | A | | 4/1974 | Fleissner | |
| 3,938,226 | A | * | 2/1976 | Roberts | 28/251 |
| 4,041,584 | A | * | 8/1977 | Williamson | 28/269 |
| 4,081,886 | A | * | 4/1978 | Roberts | 28/251 |
| 4,408,377 | A | | 10/1983 | Schippers | |
| 4,807,337 | A | * | 2/1989 | Fleissner | 28/248 |
| 6,009,606 | A | | 1/2000 | Voigtlaender et al. | |

FOREIGN PATENT DOCUMENTS

| | | |
|---|---|---|
| GB | 1023197 | 3/1966 |
| GB | 1268883 | 3/1972 |

OTHER PUBLICATIONS

European Search Report dated Aug. 25, 2008 from corresponding EP Application 08425131.

* cited by examiner

*Primary Examiner*—Amy B Vanatta
(74) *Attorney, Agent, or Firm*—Young & Thompson

(57) ABSTRACT

Crimping machine for chemical-fiber filaments with crimping chamber having an oscillating upper plate loaded with a closure force for imparting a pressure on the tow which passes through the crimping chamber, wherein the plates of the crimping chamber are mounted on respective supports through two or more linear guides provided with a roller or ball recirculation system. The longitudinal operating position is determined by two pairs of hydraulic cylinders, having an axis parallel to the linear guides, which maintain the plates, or a portion thereof, pushed against respective fixed abutments without the use of further mechanical or oleodynamic blocking elements. Load cells are arranged between the abutments and the plates, for detecting the variations of the tightening force during machine operation, the variations, representative of the variable longitudinal force imparted by the filaments of the tow being processed on the plates, are used for monitoring the quality of the crimp obtained.

19 Claims, 4 Drawing Sheets

APPARATUS FOR CRIMPING CHEMICAL-FIBRE FILAMENTS AND CONTROL METHODS THEREOF

The present invention refers to an apparatus for processing chemical fibres, such as—for example—cellulose, polyamide, polyester, polyvinyl, polyacryl, polyolefin, aramidic fibres in filaments, and in particular to an apparatus for imparting to the individual smooth filaments coming from the spinning department a continuous pleating, the so-called "crimp", which imparts to the filaments mechanical properties suitable for the subsequent processes and in particular for the spinning of the fibres obtained from cutting said filaments. Apparatuses of this type are referred to in the industry simply as "crimping machines" and the operation performed by them on the filaments is called "crimping", the only terms which will hence be referred to in the following of the present disclosure.

The invention also concerns methods for controlling crimping in said apparatus.

BACKGROUND OF THE INVENTION

For brevity's sake, reference will be made in the following only to the processing of polyester fibres, which are the most widely produced fibres—from a quantitative point of view—on the market and hence those attracting the highest economic interest. However, the present invention can be applied, with equally satisfactory results, to any chemical fibre belonging to the above-listed general categories, and it is hence in no way limited to the use with polyester fibres, specifically cited here only to illustrate and exemplify the invention.

The crimping operation lies halfway through the manufacture of polyester (PET) fibres, whose different stages will now be briefly summarised to better set the field of the technique in which the present invention is situated.

The raw material, consisting of polyester in the shape of chips or melted polymer, is produced in poly-condensation plants, generally from terephthalic acid and ethyleneglycol. In the case of chips, the dried, solid polymer is sent to extruders where the material is melted and fed to spinning pumps.

The pumps, which are volumetric pumps, feed high-pressure, melted material to spinnerets, each provided with several thousands holes with diameters under one millimeter. From the spinnerets, continuous filaments come out in a melted condition, said filaments being solidified and cooled by flow-controlled, humidity-controlled and temperature-controlled air. A spinning plant usually consists of a few up to several dozens spinnerets. Each spinneret hence produces a band of continuous filaments, which are collected by rolls and gathered together to form a single subtow, which is subsequently laid down by reels, line reels into suitable collection containers.

Due to processing requirements, during spinning the filaments are manufactured at a speed of 1.000-2.000 m/min, while the second stage of the process—which comprises drawing and stabilisation of the filaments, crimping and flock cutting—has a maximum speed of 300-400 m/min. The two stages of the process are hence separate and for this reason the subtows manufactured in the spinning stage are temporarily laid down by respective line reels into suitable collection containers, wherefrom the subtows are then taken by creels for the next processing.

Unlike the spinning stage, which occurs continuously except for the programmed maintenance/cleaning halts or those due to breakdowns, the second manufacturing stage is discontinuous and in any cycle—which may last from a few hours up to a whole day—continuous operation accounts for about 80% of the cycle and then a dwell time accounts for the remaining part of the cycle to carry out manufacture changes.

In this second stage, a certain number of subtows of polyester fibre, taken from the collection containers by a creel, are joined together to form, typically, 3 tows of the desired count; these tows are subsequently washed in a swilling and oiling tank, to remove the finish applied during the spinning stage, and to oil the fibres.

Subsequently, the tows thus treated undergo a multiple-step drawing operation until they reach the desired weight by length unit (deniering). The drawing is accomplished by drawing assemblies and each assembly generally consists of 7 or more rolls, rotating at increasing peripheral speeds for each assembly.

The first drawing is generally accomplished in hot water between the first pair of drawing assemblies; in this stage typically about 80% of the final, achievable drawing is obtained. The second stage is generally performed in steam between the second and the third drawing assembly. The overall drawing thereby reaches 400÷600%. The drawing operation orientates the molecules according to the longitudinal direction and imparts to the fibres the necessary weaving properties.

After drawing, the tows are oiled again by immersion and then treated by a set of hot drums, generally between 8 and 24 in number. On these drums the tows are dried and heated up to about 190° C. to fix the drawing effect while under tension. At the exit from the hot drums, the tows are cooled by a set of cooling drums fed with controlled-temperature water. In order to ensure that the tows are constantly under tension, sometimes, after the cooling drums a last set of drawing drums is arranged.

The tow finish, i.e. the oiling or final finishing treatment, is typically performed by a spray-type unit, provided with a dosing pump for the administration of a precise amount of size.

The three tows thus treated are finally sent to a tow overlapping unit, consisting of multiple drums, which overlaps the previously-treated tows to form a single, extended tow, having a substantially rectangular section and a width suitable for feeding it to the crimping machine. Inside the crimping machine the deformation of the individual filaments occurs by mechanical collapse due to point load of the filaments, pushed at high speed into a confined chamber. Current crimping machines operate at a maximum speed of about 400 m/min and hence represent the "slow stage" of the PET fibre manufacturing process, even though the high number of filaments they treat simultaneously allows to obtain an overall balancing of the respective capabilities between the first and the second stage of the above-described manufacturing process.

Downstream of the crimping operation, the crimped tow enters a drying oven where free-fibre (untensioned) stabilisation occurs to allow retraction thereof. The oven consists of multiple heating units and of a cooling unit. Free-fibre stabilisation makes the crimps produced by the crimping machine permanent and improves elongation to rupture.

At the exit from the drying oven, a tensioning wheel collects the tow and keeps constant the tension of the material entering a cutter, where the tow is cut into fibres of preset length (for example, typically 38 mm in the case of spun polyester) and thereby processed into flock. The product is subsequently sent for packaging.

The quality of the end product of the above-described process is largely determined by the performance of the crimping machine, so that stability and repeatability of the crimping process end up significantly affecting the entire manufacturing process of polyester fibres. As a matter of fact, while the spinning, drawing and stabilising stages have by now reached a high degree of improvement and can therefore be correctly reproduced and controlled, the crimping stage is currently still in a fully empirical stage and, in particular, no adequate control system has been devised yet which allows a reasonable forecast of the machine behaviours, on the one hand to avoid the production of insufficient or low-quality (i.e. uneven) crimped material and, on the other hand, to avoid jamming or blockages of the crimping machine.

STATE OF THE ART

Before looking in detail at the different problems highlighted during the operation of known-art crimping machines, the overcoming whereof is the object of the improvements of the present invention, in the following the general structure thereof is described with reference to FIGS. 1 and 2.

The crimping machine hence comprises a pair of opposed drums Rt and Rb, upper and lower, respectively, through which the above-defined extended tow T is fed to a confined chamber C, the so-called crimping chamber, arranged immediately downstream of the pair of drums Rt, Rb and defined, above and below, by a pair of horizontally-lying plates, upper Pt (top plate) and lower Pb (bottom plate), respectively. The crimping chamber furthermore is laterally limited by two fixed sideboards; in the most frequent embodiments, said sideboards are fastened to lower plate Pb and between the same upper plate Pt is precisely fitted, free to oscillate.

One of the two drums R (usually the lower one Rb) is mounted on the machine frame in a fixed position, free to rotate about its axis, while the other drum (the upper one Rt) is mounted, also free to rotate, on a movable support S hinged in A on said frame. Thereby the upper drum Rt is free to oscillate about fulcrum A to automatically adapt its own distance from lower drum Rb, according to the varying thickness of the tow being treated; when the machine is in a non-working condition, it is further possible to easily achieve, thanks to this mounting arrangement, a spacing apart of drums R sufficient for cleaning and maintenance operations. The function of the two drums R is of course that of introducing the polyester filament tow T into the crimping chamber C with the longitudinal thrust necessary to determine crimp forming, and for this purpose both drums are adequately motor-driven and pushed one against the other to impart a sufficient friction to tow T.

Upper plate Pt of crimping chamber C is mounted on the machine so as to be able to rotate about the same rotation axis B of the upper drum; lower plate Pb of the crimping chamber instead is rigidly connected to the frame and hence fixed. To upper drum Rt and to upper plate Pt there are applied two distinct forces, G and F, respectively, aimed at imparting a pressure to the tow drawn by the drums and to the tow during crimp forming inside confined chamber C, respectively.

At the beginning of the process, the force F acting on upper plate Pt, in the absence of any opposition, determines a rotation of said plate about fulcrum B until it brings its free end in contact with lower plate Pb; crimping chamber C during this stage hence has a closed exit arrangement.

When drums R begin to introduce the tow into the crimping chamber, due to the obstruction caused by the closed arrangement of upper plate Pt, a build-up of filaments occurs therein. The continuous introduction of tow into the crimping chamber will hence shortly generate inside a remarkable transversal pressure Ts capable of opposing, in equilibrium, force F and hence of determining the opening of upper plate Pt allowing the exit of the tow. It is to be noted that during these oscillations of upper plate Pt, no variation of the distance between the entry edge thereof and the surface of upper drum Rt occurs, precisely due to the fact that said plate Pt is hinged on the same axis of drum Rt. The system thereby keeps in balance while, during the movement of tow T inside the crimping chamber and due to the resistance encountered upon advancing, the individual filaments making up tow T collapse taking on the desired wavy shape, precisely the so-called crimp.

The above-described crimping machine is a high-power-consumption apparatus in which very strong mechanical forces are involved. The overall power of the drum-drawing motors of the crimping machine reaches 300 kW, said drums having diameters up to 350 mm and a length up to 700 mm. The tightening force of the drums must be such as to determine a linear load along the line of contact of the drums up to 40 kg/mm; for a 600-mm drum we are hence talking of a tightening force of about 24 tons. The closing force of the crimping chamber is instead of about 7-10 tons. The overall deniering of the processed tow may reach 800 ktex.

Various types of crimping machines for chemical fibres of the above-described general type have long been known and were disclosed for example in U.S. Pat. No. 3,639,955, U.S. Pat. No. 3,800,373, U.S. Pat. No. 3,946,469, EP-268,031, EP-449,630, EP-679,743. From these documents it is clear that the only option for controlling the crimping machine—the "outer" parameters, which are univocally predetermined and remain unchanged during the crimping, being the same, said parameters being, for example, the intrinsic chemical/weaving properties of the filaments to be treated, the temperature of the tow and that of the tow-feeding drums or of the crimping chamber, the input of steam, heat supply/transfer, etc. —has so far consisted in the sole adjustment of the closure force F of the crimping chamber, which force, as seen, is capable of opposing the transversal pressure which the filaments of tow T impart to plates P.

Work experience on prior-art crimping machines, however, has widely shown that, if the adjustment of force F "closing" plates P at an optimal, empirically preset value, is important for obtaining quality crimping, such adjustment to a set value, however, does not represent an effective self-regulating system of machine operation, in the light of the continuous variations of the entry conditions of tow T. In other words, by keeping a constant force F closing the crimping chamber and hence entrusting the control of operation regularity of the crimping machine only to the ability of upper plate Pt to oscillate, adjusting the opening of the outlet of the crimping chamber, depending on the variable transversal pressure imparted to the same by tow T being crimped, it is not possible to prevent the occurrence of jams and resulting blockages of the machine, which are by far the most detrimental situations from a production point of view. This probably occurs because these critical situations originate nearly exclusively in correspondence of the inlet into the crimping chamber where the pressure increase imparted by the filaments of tow T during the initial stages of jamming is not suitable, due to the modest arm in respect of fulcrum B, to determine a sufficiently prompt opening of crimp chamber C as to avert the occurrence of said jamming.

A first object of the present invention is hence that of overcoming this remarkable disadvantage of the prior art—a source of serious economic damage during manufacture—providing a crimping machine provided with adjustment means which allow to control promptly the closure force of plates P, so as to remove or at least to dramatically reduce the occurrence of the jamming of tow T inside the crimping chamber C of the machine.

Another drawback of known-art crimping machines is also that, due to the large bulk of pneumatic actuators Qr and Qp which determine the closure force G of drums R and the closure force F of plates P, respectively, the point of application of the latter typically lies in correspondence of the free end of the movable plate, i.e. normally upper plate Pt. As can be seen in FIG. 2, which schematically illustrates the structure of a known-art crimping machine, while this type of construction allows, on the one hand, to apply a closure force F of a smaller intensity (due to the longer arm) than the resultant Ts of the forces imparted by tow T being crimped in a perpendicular direction to the walls of plates P, on the other hand it causes constraint reaction Rv, which the upper plate Pt determines on the axis of upper drum Rt whereto it is hinged, to be directed upwards and hence in an opposite direction to the tightening load Rs of drums R determined by force G. This last circumstance is particularly negative when the crimping machine draws near to a jamming event; as a matter of fact, in that case, the force Ts imparted by tow T increases rapidly, and therewith the constraint reaction Rv, so that the tightening load Rs of the drums can also drop below project values. A decrease of the tightening load Rs of drums R determines of course a smaller friction force on tow T and hence a smaller longitudinal thrust on the same, hence further promoting the jamming phenomenon, so that the blockage of the crimping machine at this point becomes virtually inevitable. In known-art crimping machines, hence, in the presence of disturbances driving the machine away from equilibrium conditions, the machine reacts further departing from said conditions; these are hence typically machines characterised by unstable operation.

A second object of the present invention is hence that of providing a crimping machine which is free from this phenomenon and which, on the contrary, preferably has an increased tightening load Rs of the drums when the transversal pressure inside the crimping chamber C increases, i.e. when the crimping machine is in a condition next to jamming, so that in the presence of a disturbance the machine reacts bringing the machine back into equilibrium conditions, thereby determining a stable operation of the crimping machine.

Another drawback still of known-art crimping machines is finally that related to the very fast wear of the side plates for constraining drums R, whose functionality will be now shortly illustrated. As is evident from the above-reported general description of the crimping process, the filaments making up tow T, pressed between the two drums R, have the tendency to "escape" the grip in correspondence of the lateral areas or the passage area defined by the two drums. Therefore, without the presence of lateral constraint elements, it would not be possible to perform the crimping process correctly.

Since the individual filaments to be constrained are extremely thin, it is necessary for the lateral constraint elements to operate in close contact with the lateral surface of drums R; the state of the art hence provides the use of "sacrificial elements" for lateral constraint. Having empirically realised that the use of fixed constraint elements is fully unviable—since the chafing of the drums generates heavy local wear there, which leads to cracks or edges into which the filaments become entangled, thereby affecting the entire process—it has been resorted to the use of small circular plates of an adequate thickness, kept forcedly in contact with the lateral surface of the cylinders by hydraulic or pneumatic means, the plates being caused to rotate at subsequent steps by a preset rotation angle to even out the wear thereof. Small constraint plates of this type are described for example in U.S. Pat. No. 5,778,502.

In fact, this type of construction gives satisfactory results in terms of constraint of the filaments of tow T inside drums R, but implies a very heavy wear of the plates, which as a matter of fact must be replaced after only a few hours of operation. This is caused by the fact that, in order to guarantee an adequate seal of the plates in any operation condition, and therefore also in case of jamming overpressures, the pressure with which these are pushed against drums R must be very high at all times.

A third object of the present invention is hence that of reducing the amount of wear of the constraint plates providing a crimping machine wherein the replacement of the plates can be performed at much longer intervals, preferably only at the end of the processing cycle of an entire tow batch.

BRIEF DESCRIPTION OF THE INVENTION

The first above-described object is achieved, according to the present invention, by means of a crimping machine having the features defined in the attached main claim and by control methods having the features defined in dependent claims 17 to 19. The second above-described object is achieved by means of a crimping machine which further has the features defined in dependent claim 11. The third object of the invention is finally achieved through a crimping machine having in addition the features defined in dependent claim 13. Further features of the crimping machine of the invention are defined in the other dependent claims.

BRIEF DESCRIPTION OF THE DRAWINGS

The crimping machine of the present invention will in any case be better described in detail now, with reference to a preferred embodiment of the same, illustrated in the accompanying drawings, wherein.

DESCRIPTION OF A PREFERRED EMBODIMENT OF THE INVENTION

Figure 1:
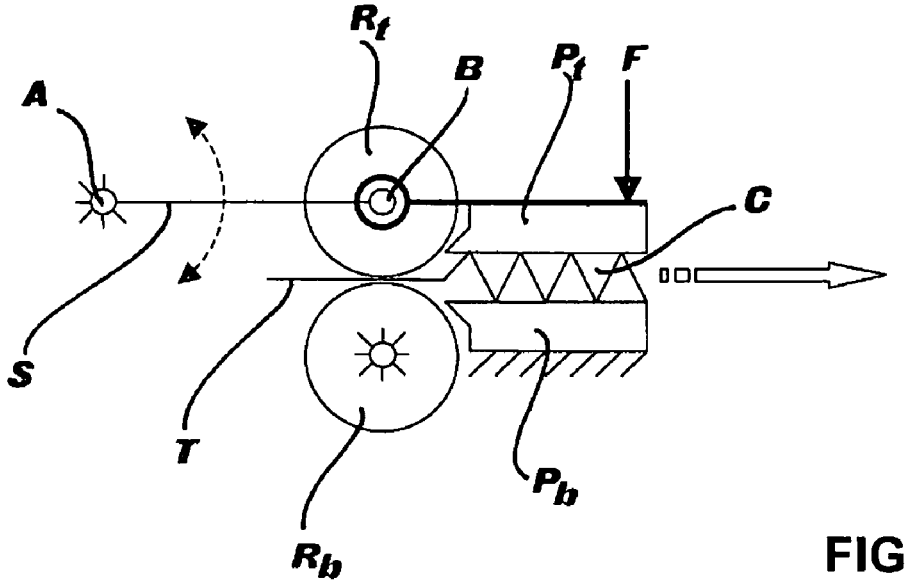
FIG. 1 is a lateral, schematic view illustrating the different functional components of a prior-art crimping machine.

In the trials carried out by the Applicant in order to come to the present invention, the attention was focused primarily on identifying the possible existence, in the crimping machine, of a directly-detectable parameter correlated to the crimp-forming phenomenon, i.e. of a parameter whose variations were adequately representative of the actual trend of the crimping operation, and which could hence be used for controlling the operation of said machine, in particular to avoid jammings of the crimping chamber. At the end of such studies, the Applicant finally believed to have identified such parameter in the longitudinal force globally imparted to the walls of the crimping chamber by the filaments of tow T, due to the friction resulting from the tow being crimped moving within the crimping chamber against the walls P of said chamber. As a matter of fact, according to the hypothesis which informed the Applicant's trials, the variations of such longitudinal force should promptly signal the departing from the equilibrium operating conditions and hence allow consequent controlling actions on the closing force of the crimping chamber.

On the contrary to known-art crimping machines hence, wherein the closure force F of the crimping chamber is empirically determined a priori and remains constant for the whole operation cycle of the machine, in the crimping machine according to the present invention it has been considered to vary the closure force F according to the above-said detected parameter, so as to allow reduction of the closure force as soon as the measured longitudinal force on the walls of the crimping chamber exceeds a threshold value, signalling the onset of a jamming event. Thereby, according to the invention, a much prompter opening of the crimping chamber than that occurring in conventional crimping machines—which operate at a constant closure force—can be achieved, thereby preventing jammings from the onset.

The first field trials performed by the Applicant have confirmed that the detection of the longitudinal force imparted by the filaments of tow T against the walls of the crimping chamber C allows a direct reading of the process trend and of the deviation thereof from optimal values. On the crimping machine a feedback-loop control system may hence be provided, for the purpose of maintaining the value of said longitudinal force close to a preset reference value, which is related to an improved crimping quality, suitably changing the closure force of upper plate Pt, depending on the difference between the longitudinal measured force and the above-said reference value.

Of course, upon the first formulation of this hypothesis, the Applicant found himself faced with the problem—at that time apparently impossible to overcome—of having to equip the plates P of the crimping chamber, or at least one thereof, with a degree of freedom in a longitudinal direction, to be able to detect the load transmitted to the same by the crimp being formed. It has been stated that the problem seemed impossible to overcome because the fact is by now unquestionable, in the prior art of this field, that during operation plates P must be securely arranged with their blade-shaped front end in close proximity with the surface of drums R, with an invariable clearance of the order of a few tenths of a millimeter, to prevent the filaments of tow T coming out at high speed from drums R from becoming entangled or wedged in said clearance, quickly causing machine stoppage.

In fact, during the research carried out, the Applicant had traced also a first attempt, disclosed in U.S. Pat. No. 4,408,377, to apply a detection technique of the longitudinal force imparted to the walls of a crimping chamber in a texturing machine of a multiple-filament yarn. However, in such patent it had been considered to build the crimping chamber in two sections, sliding on each other through different means, so as to be able to keep the section adjacent to the drums fixed and the end one movable. The longitudinal thrust effect which the yarn being textured imparts to the inner wall of such movable end section could hence be measured and used to vary the discharge resistance at the outlet of the texturising chamber.

A solution of this type, however—in addition to the fact that it is of course applicable only in the case of small devices and of modest forces at play, as occurs precisely in the case of texturing—cannot in any case have a direct application to a tow-crimping machine, already only considering the fact that the presence of a discontinuity along the inner walls of the crimping chamber—i.e. that which would form in correspondence of the joining area between the two sections of which this would be formed—in addition to a variable width during the process, would certainly be fully incompatible with the particularly strict requirements—in terms of surface smoothness and absence of any possible snag—of a crimping machine. The only device to overcome such drawback would be that of manufacturing the end part of the crimping chamber with a slightly wider dimension than the initial part thereof, but this would cause a worsening of the crimping quality achieved.

But certainly the most relevant drawback of the solution suggested in U.S. patent '377 is that the detection of the longitudinal force occurs in the end part of the crimping chamber where, for the reasons already illustrated above, the phenomenon of the pressure increase of the filaments in case of jamming occurs in a limited and late manner, the most relevant part of the phenomenon as a matter of fact developing in the very initial area of the crimping chamber, immediately downstream of drums R. A detection of the longitudinal force on the crimping chamber performed in the ways suggested by the prior-art document does hence not allow to have a control system which is more reactive and sensitive than the conventional one; on the contrary, it is believed that this is probably the main reason why the apparatus in question did not find actual industrial application, not even in the field of texturing.

The present invention hence aims to define an innovative architecture of the crimping machine which, despite allowing the accurate detection of the longitudinal thrust imparted by the crimp being formed to the walls of crimping chamber C, maintains those requirements of perfect surface continuity and of constant stability of the initial position of plates P limiting the crimping chamber, that the experience has already proved to be fully essential requirements for carrying out correctly the crimping operation.

Given the relevance of the longitudinal thrusts on the crimping chamber, as a matter of fact all known crimping machines provide a rigid mechanical locking of the upper and lower plates, so as to exclude any freedom of movement of these elements during the operation stages.

The present invention, through an innovative architecture which provides improved rigidity and increased mechanical assembling precision than that achieved by the current state of the art, allows instead to avoid the mechanical locking of the upper and lower plates, allowing longitudinal movement thereof also in operation and consequently enabling a continuous measurement of the longitudinal force imparted by the tow to plates P.

Figure 4:
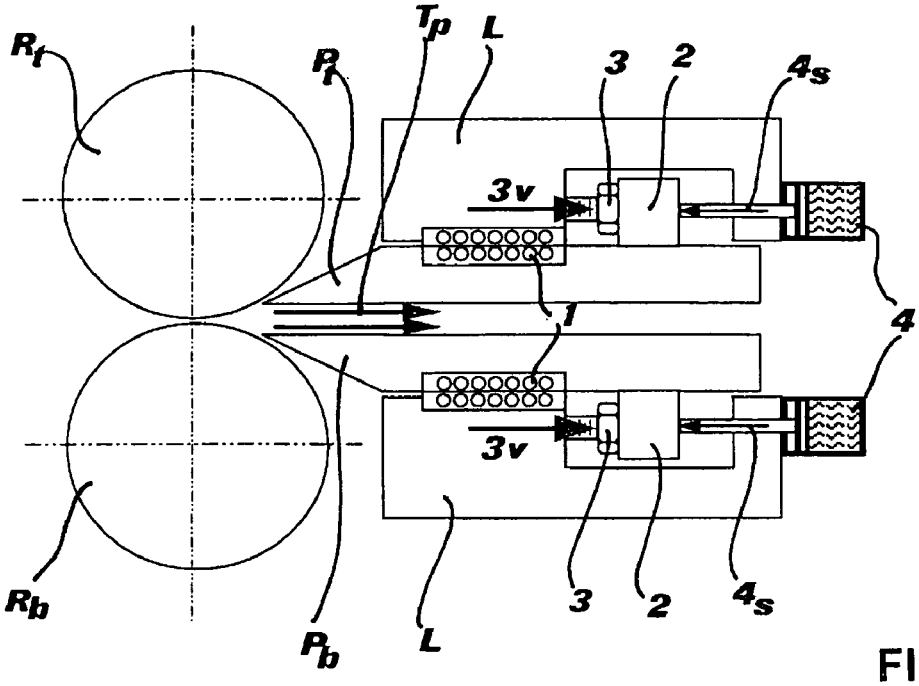
FIG. 4 is a schematic lateral view of the crimping machine according to the present invention illustrating the mounting system of the plates which limit the crimping chamber.

In order to guarantee an always correct configuration of plates P, without any lateral displacement or angular misalignment of the same during operation and, at the same time, a longitudinal movement of the plates without friction, the mounting of plates P on respective supports L has been achieved through two or more linear guides 1 which are parallel for each plate P—preferably three guides, for plates P about 500 mm wide—provide with a roller or ball recirculation system of the type used in machine tools (FIG. 4). As a matter of fact, these components are characterised precisely by a very low friction coefficient and by a high positioning precision. The desired longitudinal arrangement of plates P is then achieved by keeping plates P pushed, through a pair of projecting portions 2 thereof (arranged on both sides of each plate P), against corresponding fixed abutments 3 integral with the supports L of plates P. The thrust against projection portions 2, in the direction of arrows 4*s*, is imparted directly by pairs of hydraulic cylinders 4, preferably with parallel axis to said guides and mutually balanced as regards pressure, themselves fixed to supports L.

Before starting the crimping machine, the end position of abutments 3 is adjusted, after which the actuation of cylinders 4 allows to bring plates P exactly into the desired position with the entry edge adjacent to the surface of drums R, in which position the plates are maintained securely in position due to the action of cylinders 4. According to an innovative feature of the invention, the pressure of hydraulic cylinders 4 is initially adjusted to values such that the thrust globally imparted by these is in any case greater than the maximum longitudinal force Tp which the tow can determine on each of plates P; thereby, the longitudinal position of plates P remains unchanged during the operation of the crimping machine, while the degree of longitudinal freedom acquired by the plates allows an easy and reliable measurement of the above-said longitudinal force and, especially, of the variations thereof over time, individually for each of plates Pt and Pb and, separately, for each of the two sides of said plates.

During the normal operation of the machine, the longitudinal force Tp imparted by tow T being crimped on plates P will imply a drop of the constraint reaction 3*v* imparted by each of abutments 3 for maintaining the system in equilibrium. The interposition of load cells (not shown in the drawings) between each abutment 3 and the respective projecting portion 2 of plates P hence allows to measure directly and easily the amount of longitudinal force Tp and to consequently obtain indications on the state of progression of the crimping process. The load cells used in the first practical applications had a bottomscale value of 200 kN and an average operating value of 100-120 kN.

Due to the particular construction described above it is possible and preferable, from the point of view of the ease of measurement, to adjust the load cells to the value 0 in correspondence of the maximum working pressure of cylinders 4. During operation of the crimping machine the load cells will hence detect negative load values as longitudinal force Tp increases, which values hence represent—apart from the sign—a direct measurement of the variations of such force.

The measurement of longitudinal force Tp imparted by tow T to plates P is of course the more significant the less such reading is affected by the presence of stresses generated by misalignments of the machine, which misalignments might overlap in an uncontrolled way with force Tp making the reading thereof less significant. For this reason, according to the invention, in addition to the introduction of linear guides 1 for the sliding support of plates P, it has also been provided to amend the support structure of upper plate Pt to axis B of drum Rt, so as to minimise any possible machine misalignment.

Figure 3:
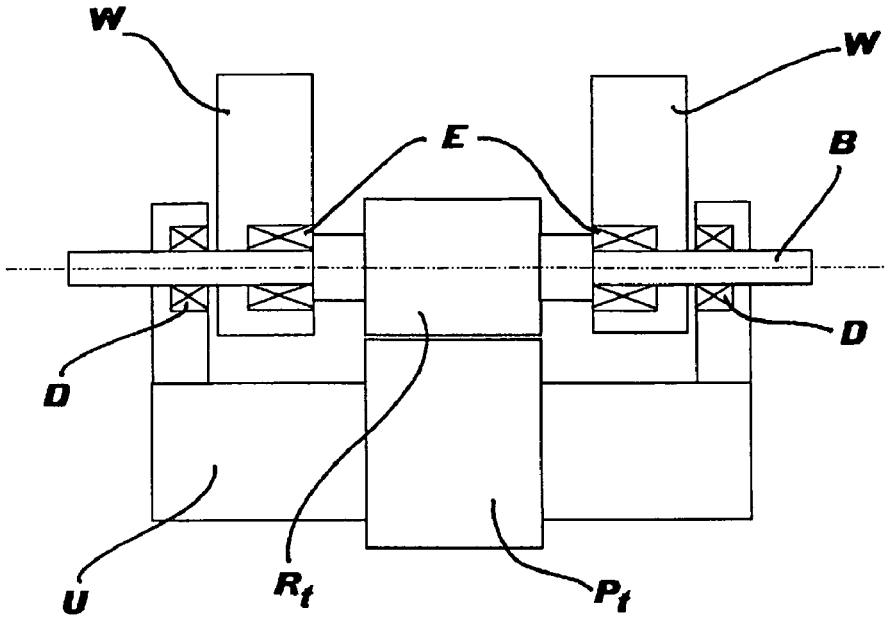
FIG. 3 is a schematic top-plan view illustrating the mechanical structure of a prior-art crimping machine.

As a matter of fact, normally, as schematically illustrated in FIG. 3, upper plate Pt is directly hinged, through bearings D, on the same shaft B of upper drum Rt through a yoke structure U. Despite greater construction simplicity, however, this solution implies two very negative aspects: on one side, the inevitable plays of the bearings E of upper drum Rt—subject to heavy wear, given the high rotation speed—generate alignment errors which transmit, amplified, to upper plate Pt; on the other side, such solution is characterised by a bulky structure, considering the large transversal extension which yoke U must have, a structure which therefore cannot have the rigidity sufficient to maintain a constant and perfect alignment during the operation of the crimping machine.

This type of architecture therefore did not allow the implementation of the control system through load cells, since the value of the longitudinal force measured by such cells (a parameter which has proved to be highly indicative of the process trend) would be "spoiled" by the "noise" generated by mechanical imprecisions.

Figure 5:
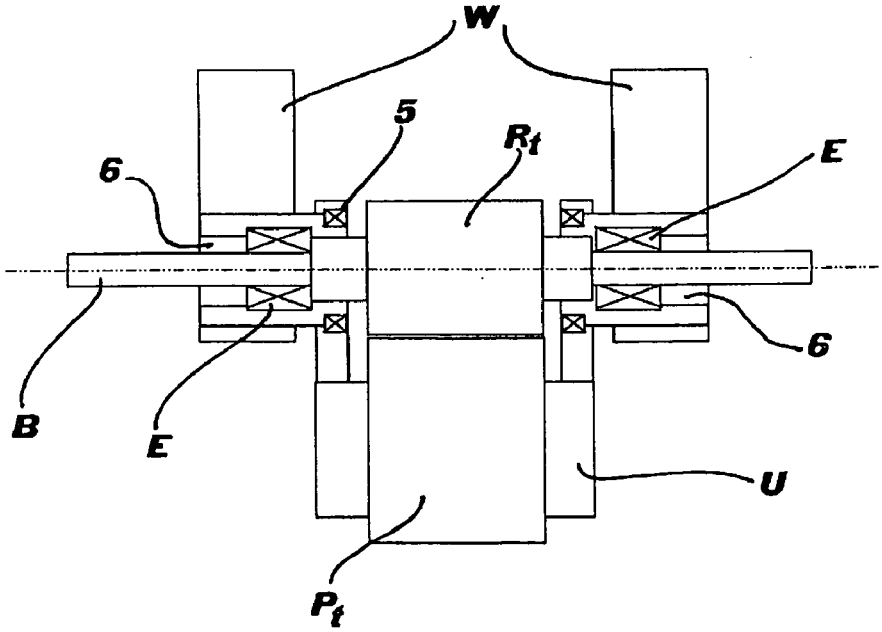
FIG. 5 is a schematic top plan view illustrating the mechanical structure of the crimping machine according to the present invention.

The architecture of the crimping machine according to the present invention (FIG. 5) provides instead that upper plate Pt be hinged, through bearings 5, to suitable support bushes 6 of the bearings E of drum Rt. Bushes 6 are rigidly connected to frame W, whereon drum Rt is pivoted, and hence any alignment error on yoke U is completely removed, which is generated by any plays existing or arising during use on the bearings E of such drum.

In this new type of architecture of the crimping machine, a reference fully devoid of plays is hence guaranteed to the support bearings 5 of upper plate Pt, hence to the full advantage of mechanical precision and position stability of said plate during normal operation, and thereby reducing to a minimum alignments mistakes.

Moreover, due to the fact that the support bearings 5 of upper plate Pt are mounted towards the inner side of the crimping machine, the structure of yoke U supporting the upper plate becomes much more compact, and hence more rigid, thereby contributing to a further minimisation of the alignment errors.

Due to the above-described structure of the crimping machine, the indications supplied by the load cells concerning the longitudinal force Tp imparted to plates P of the crimping chamber are actually representative of the effort imparted by the filaments being crimped to the inner walls of said plates and hence represent a clear, direct and immediate indication of the state of the process under way.

Thereby, adjusting the closure force F of the crimping chamber according to the new parameter thereby detected, it becomes possible to maintain such parameter around an optimal value thereby guaranteeing excellent evenness of the crimping quality during the entire process, both in terms of crimping index and of crimping rate, which quality so far had not been controllable in any way but through empirical actions by highly skilled technicians. Due to this new apparatus arrangement, it is furthermore extremely simple to devise computer programmes for the continuous analysis of the detected values, with special reference to the trends over time and to any areas of discontinuity, so as to be able to pre-empt the adjustment actions as necessary to achieve as even a crimping as possible.

In particular, by the apparatus of the invention it becomes immediately and easily possible to pre-empt the situations of possible jamming of the crimping machine, promptly reducing the closure force F of the crimping chamber C whenever an increase of longitudinal force Tp is detected; this determines a greater opening of the crimping chamber and hence a quick solution to the processing abnormality without reaching jamming of the machine. This allows to dramatically reduce machine standstill times and the relevant remarkable costs, both in terms of missed production and of waste of the material produced during the plant stopping and restarting steps. The first object of the invention is hence thereby fully achieved.

From the preceding description it is evident how each plate P of crimping chamber C is provided with a load cell on both sides thereof. This allows to detect not only the absolute value of longitudinal force Tp, but also the differential value thereof between the right and left side of the machine, hence allowing to provide a prompt warning of any abnormalities in the supply modes of incoming tow T, due to misalignments or other possible malfunctioning of the machines upstream of the crimping machine.

Finally, it is pointed out that in the preceding description exclusive reference has been made to the detection of longitudinal force Tp through the use of load cells. However, it is clear that the use of such measurement instruments must not be understood in a limiting sense to the invention, since such load cells may be replaced without consequences by other instruments capable of detecting the variations of the constraint reaction 3*v* between projecting portions 2 and the respective abutments 3. In particular, the reading of the longitudinal force Tp on plates P forming the crimping chamber could be effected for example by detecting—through suitable pressure transducers variations of the counterpressure existing in the chamber of hydraulic cylinders 4 pushing plates P, after having confined to a closed volume (i.e. without connections to a tank) the fluid therein contained.

The innovations introduced in the crimping machine of the invention are now going to be illustrated in connection with the second object of the invention, i.e. the maintenance of a constant tightening force Rs between drums Rt and Rb, or better, a slightly increasing force, even in the presence of a transversal force Ts, overall imparted by tow T to plates Pt and Pb, higher than the one found in standard conditions.

Figure 2:
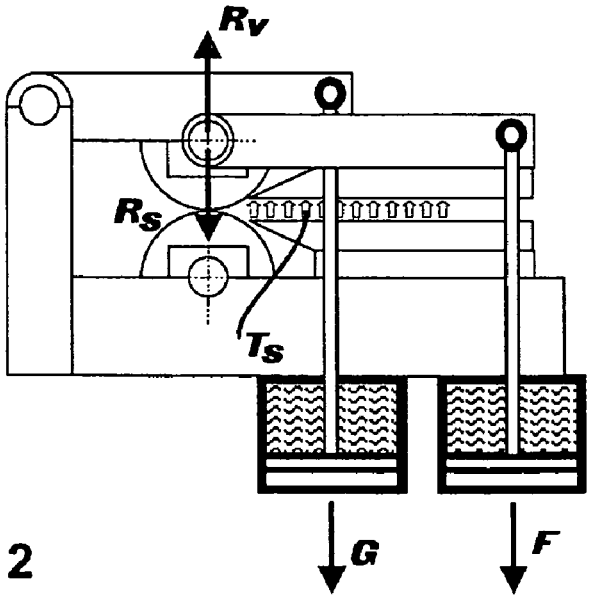
FIG. 2 is a schematic lateral view illustrating the mechanical structure of a prior-art crimping machine.

As said in the preliminary remarks of the present description and with reference to FIG. 2, the structure of conventional crimping machines, precisely due to the large bulk of pneumatic thrust cylinders Q, provides that the closure force of crimping chamber C be applied in correspondence of the outlet edge of plates P, with the result that the constraint reaction Rv charging onto axis B of drums R has an opposite versus to the tightening force Rs of the same. This hence implies an overall reduction of the tightening force between drums R when the transversal thrust Ts imparted by the filaments of tow T to movable plate Pt increases beyond the project values, with the resulting drop of the longitudinal thrust on tow T due to the reduced friction imparted by the drums to the same. This in turn determines a variation of the crimping rates performed on the filaments and represents an invitation to jamming.

In the present invention, taking into account what has just been set forth, the application point of closure force F of plates P has instead been moved to a position comprised between the resultant Ts(r) of the transversal thrust Ts imparted by the filaments being crimped and the pivoting axis B of yoke U.

The change of position of the point of application of closure force F of upper plate Pt to a position closer to the axis B of drums R, with respect to the resultant Ts(r) of transversal thrust Ts imparted by tow T to said upper plate Pt, is possible by using—instead of conventional pneumatic plunger actuators G—pneumatic springs 7 and 8, for the tightening of drums R and for closure of crimping chamber C, respectively.

Thanks to this construction, the constraint reaction Rv determined on axis B by force F is oriented in the same direction as the tightening force Rs determined by force G, for the benefit of the process, especially when the values of the thrust Ts imparted by tow T are higher than normal (for example before a possible jamming), since in the presence of an increase of the transversal force imparted by tow T an increase of the constraint reaction Rv and hence ultimately an increase of the overall tightening force Rs+Rv is determined. As a matter of fact, as thrust Ts increases, a modest displacement towards the opening of yoke U is determined and consequently an increase of closure force F due to the increased compression of pneumatic spring 7 until reaching a new situation of equilibrium, wherein an increase of the longitudinal thrust imparted by drums R to the tow is hence determined. This overall increase of forces and the slight opening displacement of U tend to automatically solve the abnormal obstruction situation which originated the increase of force Ts, improving system stability also from this point of view.

Figure 6:
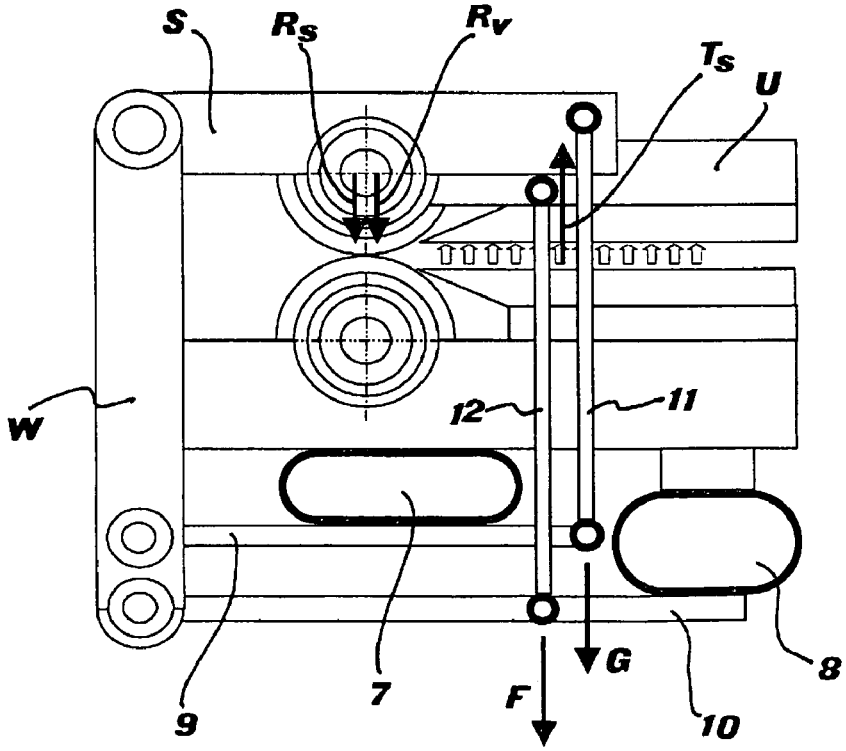
FIG. 6 is a schematic lateral view illustrating the mechanical structure of the crimping machine according to the present invention.

Actuators 7 and 8 are arranged between the frame W of the crimping machine and respective support planes 9 and 10 whereon they rest with the bottom side thereof. Support planes 9 and 10 are hinged on a side thereof to the same frame W and are hence connected to the respective elements of application of the force—i.e. support S of upper drum Rt and yoke U which controls upper plate Pt—through pairs of connecting rods 11, 12 (only one of which is naturally visible in the lateral view of FIG. 6) hinged to such elements and to the support planes in a suitable position for allowing the inversion of the above-described constraint reaction Rv. In particular, while connecting rods 11 are arranged in a similar position to the pistons of the usual actuators, connecting rods 12 may be arranged in a much more backward position than the conventional one of the free end of movable plate Pt, and precisely beyond the point of application of the resultant Ts(r) of transversal forces Ts imparted by tow T to the walls of crimping chamber C.

Due to this construction, the crimping machine of the invention is hence capable of fully achieving also the second proposed object.

The third object of the present invention, as seen, is finally to change the lateral constraint system of the individual filaments which make up tow T, so as to considerably increase the duration of the sacrificial elements of such system, i.e. of the constraint plates.

This object is achieved by changing the pressure application circuit which controls the thrust imparted by the plates against the lateral surface of drums Rt and Rb. In the prior art these plants are both of a hydraulic and pneumatic type and operate maintaining the plates pushed against the lateral surface of drums R at a very high pressure, so as to have the guarantee that the contact remains correct also in case of lateral overpressures of tow T beyond the standard values, as ascertained during the initial stage of a jamming of crimping chamber C. They are hence systems operating under a "constant load".

Figure 7:
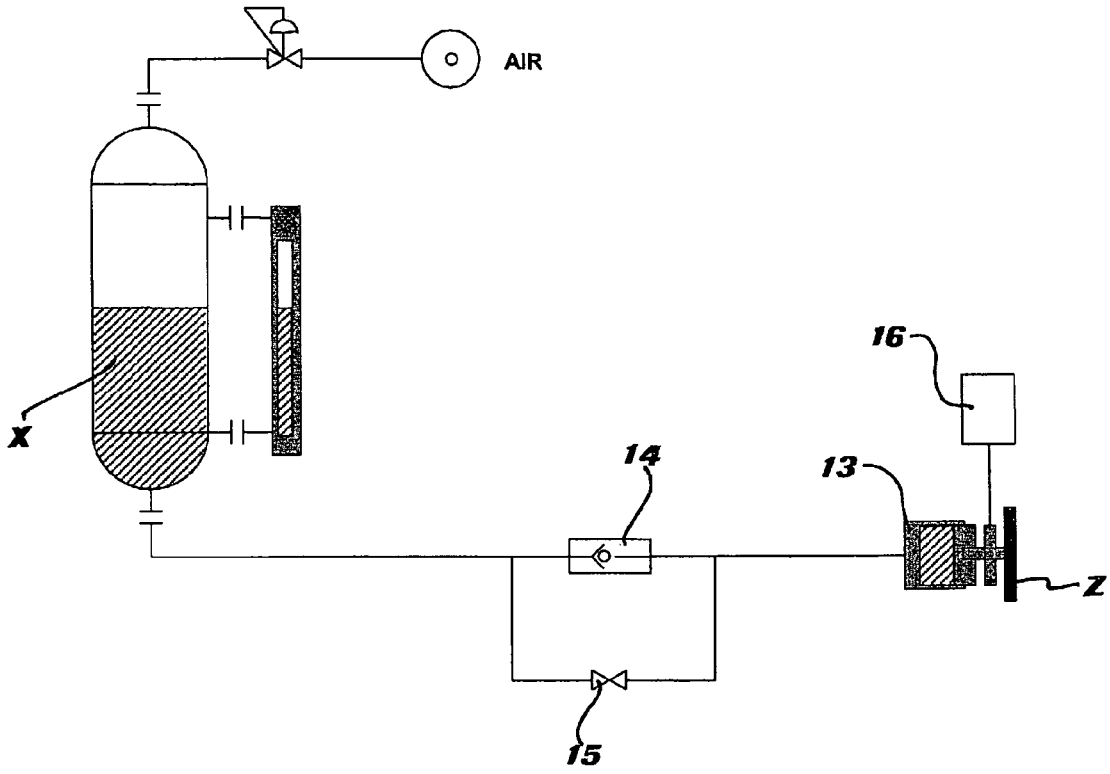
FIG. 7 is a diagram of the pneumo-hydraulic control circuit of the position of the lateral constraint plates of the drums.

According to the present invention, on the contrary, and as clearly illustrated in FIG. 7, the control circuit of plates Z is arranged so as to maintain said plates in a "constant position", regardless of the pressure which is applied to the same by tow T being processed. For this purpose, a pneumo-hydraulic circuit is provided comprising a tank X partly filled with fluid and kept at constant pressure by compressed air (AIR) introduced into the upper part thereof. A cylinder 13 controls the thrust onto plate Z and is supplied with the fluid of tank X through a one-way valve 14 which allows to exclude any backflow of working fluid from cylinder 13 to tank X, when a respective by-pass valve 15 is closed. An electric motor 16 controls, in a way known per se, the rotation of plate Z to even out the wear thereof.

At the beginning of the processing, according to the innovative feature of the invention, plates Z are pushed against drums R at a much lower pressure than the one conventionally used to oppose the thrust of tow T in the heaviest working conditions, preferably below 50% of said pressure and even more preferably even up to about 25% of such pressure, suitably adjusting the pressure of the compressed air fed to the upper part of tank X, after which by-pass valve 15 is closed. Whenever a thrust increase by tow T occurs, such as to overcome the thrust imparted by plates Z, one-way valve 14 closes and does not allow backflow of the fluid from cylinder 13 to tank X, hence forcing this circuit part to work with a closed volume of fluid. Assuming this volume of liquid as incompressible, the pressure inside the final part of the circuit will automatically rise to the extent necessary to oppose the pressure increase generated by tow T and the backward movement of plates Z, due to such pressure increase, will hence be fully negligible.

In practice hence plates Z are kept in a fixed position in contact with the lateral surface of drums R, with the minimum necessary force, exploiting the incompressibility of the fluid to resist the thrust peaks which may occur during processing. Although the hydraulic circuit used for controlling plates Z illustrated in FIG. 7 is a mixed pneumo-hydraulic circuit—whose arrangement is well-known per se and hence is not described here in further detail—nothing prevents the use of fully hydraulic circuits. As a matter of fact, for the purposes of the invention it is sufficient that only the end part of the circuit be hydraulic, so as to exploit the incompressibility of liquids to maintain a fixed position of plates Z upon varying of the thrust imparted to the same by tow T.

This method for controlling the position of the plates brings remarkable advantages. Firstly, the useful life of the plates is remarkably increased, up until covering an entire production shift, thereby fulfilling also the third object of the invention. Moreover, the thermal and mechanical stresses resulting from the chafing between plates Z and drums Rt and Rb are remarkably diminished, so as to significantly reduce the wear of the drum edges and to make the cooling operations of the same easier.

The present invention has been described with reference to a preferred embodiment of the crimping machine, but it is obvious that a number of changes may be made to the same, within the easy reach of a person skilled in the field, without departing from the scope of the invention, which is defined solely by the attached claims.

The invention claimed is:

1. Apparatus for crimping a plurality of continuous filaments of chemical fibres, joined together in an extended, substantially-rectangular-section tow, of the type comprising a pair of motor-driven drums (Rt, Rb) for supplying tow into a confined chamber (C) where crimping occurs, arranged immediately downstream of said drums (Rt, Rb) and consisting of a pair of opposite plates (Pt, Pb), one of said drums (Rb) being mounted on the frame of the apparatus in a fixed position, free to rotate about its axis, while the other drum (Rt) is mounted, itself free to rotate, on a movable support (S) hinged to the frame (W) of said apparatus, one of said plates (Pb) being mounted on the frame of the apparatus in a fixed position, while the other plate (Pt) is hinged to the same axis of rotation (B) of the corresponding drum (Rt), a tightening force (Rs) being applied to the movable drum (Rt), for imparting a drawing pressure on the tow, and a closure force being imparted to said movable plate (Pt), for imparting a pressure to the crimp-forming chamber (C), characterised in that at least one of said plates (Pt, Pb) is mounted on a respective support (L) through two or more linear guides, provided with a double roller or ball recirculation system, parallel to the progression direction of tow (T), and the longitudinal position thereof is determined by a pair of hydraulic cylinders (4) which, in the absence of other mechanical or oleodynamic locking systems, maintain said plate, or a portion thereof, pushed against respective fixed abutments (3), said hydraulic cylinders (4) and said fixed abutments (3) being both fixed to said plate support (L), and in that one or more force detection means are arranged between said support (L) and said plate (Pt), for detecting the changes in the tightening torque during apparatus operation, said changes being representative of the variable longitudinal force (Tp) imparted by the filaments of the tow (T) being processed on said plate (Pt).

2. Crimping apparatus as claimed in claim 1), wherein said force detection means is arranged between each of said fixed abutments (3) and a corresponding projecting portion (2) of said plate (Pt).

3. Crimping apparatus as claimed in claim 1), wherein said force detection means is a load cell.

4. Crimping apparatus as claimed in claim 3), wherein said load cell is set to zero at the standard closure pressure of said hydraulic cylinders (4).

5. Crimping apparatus as claimed in claim 1), wherein said load force detection means is a pressure transducer capable of detecting the pressure in said hydraulic cylinders (4), when the relative supply circuit is closed.

6. Crimping apparatus as claimed in claim 1), wherein said cylinders have an axis parallel to said linear guides.

7. Crimping apparatus as claimed in claim 1), wherein said cylinders (4) are balanced in their internal pressure.

8. Crimping apparatus as claimed in claim 1), wherein a yoke (U) supporting the movable plate (Pt) is pivoted on bearings (5) housed in bushes (6), integral with the apparatus frame (W) and coaxial with the shaft (B) of the movable drum (Rt).

9. Crimping apparatus as claimed in claim 8), wherein said bushes (6) also house bearings (E) supporting said movable drum (Rt).

10. Crimping apparatus as claimed in claim 9), wherein the bearings (5) supporting the movable plate (Pt) are arranged inside the bearings (E) supporting the movable drum (Rt).

11. Crimping apparatus as claimed in claim 1), characterised in that said closure force of the movable plate (Pt) is applied in a position comprised between the application point of the resultant (Ts(r)) of the transversal force (Ts) imparted by the filaments of the tow (T) against the movable plate (Pt) and the pivoting axis (B) of said plate.

12. Crimping apparatus as claimed in claim 11), wherein said closure force of the movable plate (Pt) is applied by a pneumatic spring (8), arranged between the apparatus frame (W) and a support plane (10) hinged in correspondence of a side thereof to said frame (W) and connected with its oscillating portion to the yoke (U) supporting said movable plate (Pt) by a pair of connecting rods (12).

13. Crimping apparatus as claimed in claim 12), wherein said tightening force of the movable drum (Rt) is imparted by a pneumatic cushion spring (7), arranged between the apparatus frame (W) and a support plane (9) hinged in correspondence of a side thereof to said frame (W) and connected with its oscillating portion to the support (S) of said drum (Rt) by a pair of connecting rods (11).

14. Crimping apparatus as claimed in claim 1), further comprising small plates (Z) constraining the filaments of tow (T), said plates being arranged in correspondence of the contact area between said drums (Rt, Rb) and in contact with the lateral surface of the same, characterised in that the position of each of said plates in the direction parallel to the axes of said drums and towards the inside of the same is controlled by the thrust of a respective hydraulic cylinder (13) fed with a lower pressure than the pressure necessary for constraining tow (T) between said drums (Rt, Rb) in the heaviest operating conditions, and in that at least the end portion of a liquid supply circuit to said cylinder (13) is a closed-volume one during apparatus operation.

15. Crimping apparatus as claimed in claim 14), wherein the closed-volume condition of the circuit supplying liquid to said hydraulic cylinder (13) is achieved through a one-way valve (14) arranged upstream of said cylinder (13).

16. Crimping apparatus as claimed in claim 14), wherein the supply pressure of said hydraulic cylinder (13) is below 50% of the pressure necessary for constraining the filaments of the tow (T) between said drums (Rt, Rb) in the heaviest operating conditions.

17. Method for controlling crimping of a plurality of continuous, chemical-fibre filaments, joined in an extended tow having a substantially rectangular section, in an apparatus as claimed in claim 1), wherein the continuous detection of the value of the longitudinal force (Tp) imparted by the tow (T) against the inner wall of at least one of the plates (Pt, Pb) defining the crimping chamber (C) is used for continuously monitoring the quality of the crimp obtained.

18. Method for controlling the crimping of chemical-fibre filaments as claimed in claim 17), wherein the closure force (F) of the movable plate (Pt) of the crimping chamber (C) is adjusted according to the instant detected value of the longitudinal force (Tp) imparted by the filaments of the tow (T) to the inner wall of at least one of the plates (Pt, Pb) which define the crimping chamber (C).

19. Method for controlling the crimping of the chemical-fibre filament as claimed in claim 17), wherein the differential of the longitudinal force (Tp) imparted by the tow (T) against the inner wall of at least one of the plates (Pt, Pb) defining the crimping chamber (C), as detected between the right side and left side of said plate, is used as an indicator of malfunctioning of the tow-forming devices located upstream of said apparatus.

* * * * *